US011485613B1

(12) United States Patent
Phillips et al.

(10) Patent No.: US 11,485,613 B1
(45) Date of Patent: Nov. 1, 2022

(54) LIFTING AID FOR ATTIC LADDER SYSTEM

(71) Applicants: Charles Phillips, Murrells Inlet, SC (US); Cameron Phillips, Murrells Inlet, SC (US)

(72) Inventors: Charles Phillips, Murrells Inlet, SC (US); Cameron Phillips, Murrells Inlet, SC (US)

( * ) Notice: Subject to any disclaimer, the term of this patent is extended or adjusted under 35 U.S.C. 154(b) by 390 days.

(21) Appl. No.: 16/811,524

(22) Filed: Mar. 6, 2020

Related U.S. Application Data

(60) Provisional application No. 62/814,997, filed on Mar. 7, 2019.

(51) Int. Cl.

| | |
|---|---|
| ***E06C 7/00*** | (2006.01) |
| ***E06C 7/16*** | (2006.01) |
| ***B66B 9/16*** | (2006.01) |
| ***B66B 9/08*** | (2006.01) |
| ***B66B 9/187*** | (2006.01) |
| ***B66D 1/54*** | (2006.01) |
| ***B66D 1/26*** | (2006.01) |
| *E04F 11/04* | (2006.01) |
| *E06C 7/12* | (2006.01) |

(52) U.S. Cl.
CPC ..... *B66B 9/187* (2013.01); *B66D 1/26* (2013.01); *B66D 1/54* (2013.01); *E04F 11/04* (2013.01); *E06C 7/12* (2013.01); *E06C 7/16* (2013.01)

(58) Field of Classification Search
CPC .. B66B 9/187; B66D 1/26; B66D 1/54; E04F 11/04; E06C 7/12; E06C 7/16
See application file for complete search history.

(56) References Cited

U.S. PATENT DOCUMENTS

| | | | | |
|---|---|---|---|---|
| 2,405,505 | A * | 8/1946 | Kleidon | E06C 7/12 187/241 |
| 5,911,287 | A * | 6/1999 | Campbell | E06C 7/12 182/103 |
| 6,244,381 | B1 * | 6/2001 | Ruble | E06C 7/12 182/103 |
| 6,962,236 | B2 | 11/2005 | Penn | |
| 7,140,466 | B2 | 11/2006 | Penn | |
| 7,357,223 | B2 | 4/2008 | Penn | |
| 7,900,745 | B1 * | 3/2011 | Tindal | E06C 7/16 182/103 |
| 7,963,505 | B2 | 6/2011 | Taylor et al. | |
| 8,418,814 | B1 | 4/2013 | Byers | |
| 8,851,238 | B2 | 10/2014 | Byers | |
| 2013/0068559 | A1 * | 3/2013 | Grado | E06C 7/12 182/102 |
| 2015/0273250 | A1 * | 10/2015 | Bina | B66B 9/187 182/8 |
| 2015/0300090 | A1 * | 10/2015 | Strand | E06C 7/12 182/103 |
| 2016/0159613 | A1 * | 6/2016 | MacDonald | E04F 11/064 187/245 |

* cited by examiner

*Primary Examiner* — Tan Le
(74) *Attorney, Agent, or Firm* — Cramer Patent & Design, PLLC; Aaron R. Cramer

(57) ABSTRACT

A lifting aid for an attic ladder includes a track system having a plurality of attachment means configured to secure about a corresponding number of attic ladder rungs. A hand winch is secured to the base of the device and is in mechanical operation with a tray which runs up and down the attic ladder to which the track system is secured.

18 Claims, 5 Drawing Sheets

LIFTING AID FOR ATTIC LADDER SYSTEM

RELATED APPLICATIONS

The present invention claims the benefit of U.S. Provisional Application No. 62/814,997, filed Mar. 7, 2019, the entire disclosures of which are incorporated herein by reference.

FIELD OF THE INVENTION

The presently disclosed subject matter is directed to a lifting aid and more specifically to a lifting aid for an attic ladder system.

BACKGROUND OF THE INVENTION

There is a seemingly endless list of activities performed at home, work, and in many other environments that require the use of a ladder in order to allow its user to gain access to areas that otherwise would be inaccessible. While spending time on a ladder is usually never a great deal of fun, it becomes even less fun should repeated trips up and down the ladder for tools, material, and equipment be required.

Not only does such action put stress and strain on the users back and legs due to the climbing action, it also increases the risk for falling, since the user's center of gravity is moved away from the ladder. Also, the weight of the items being carried coupled with awkward sizes not only increases risk of back, shoulder and arm injury, but increases the risk of falling as well. These same problems exist when carrying items such as holiday decorations up and down a folding attic ladder. Accordingly, there exists a need for a means by which one can easily transport tools, material, or equipment up or down ladders, particularly attic ladders, without the disadvantages as described above. The development of the lifting aid for attic ladder system is such a solution.

SUMMARY OF THE INVENTION

The principles of the present invention provide for a load lifting system comprises a ladder having a plurality of steps, a plurality of step braces engaging the respective steps of the attic ladder by wrapping around the front, rear, and entire top of each of the respective steps, a rail having a hollow rectangular tubular element with a longitudinal groove which is located at a center point of the upper surface and coextensive with the length of the rail, a belt guide having a hollow rectangular tubular element with an open upper end and an open lower end, a winch mounting plate which is secured to a bottom surface of the belt guide with at least one fastener and extends rearwardly, a pair of rollers vertically aligned with each other and are rotatably mounted to one or more inner surfaces of the belt guide and are located adjacent to the open bottom end, a platform floor having a platform wall, the platform floor traveling downward along the rail, the platform floor preferably is a planar member having a centrally located portion that protrudes downward and is captured within the longitudinal groove of the rail, a ratchet gear and a corresponding stop lever provided to ensure that platform floor and the platform wall does not accelerate downward in an unwanted manner, a pulley which is attached to an inner surface of the belt guide and extending forwardly away from the upper open end and a belt which has a first end which is attached to the winch and is operably controlled thereby and a second end.

The load lifting system is installed on the steps of the ladder. The second end of the belt is attached to the platform floor and the belt travels between said pair of rollers within said belt guide and engages said pulley. The step braces are affixed to a bottom surface of either the rail, the belt guide, or the center of the combined rail and the belt guide. There is a reverse movement when the winch releases the tightness of the belt against the platform floor enables the platform floor to travel downward along the rail.

The load lifting system may be installed on the steps of the attic ladder at a midpoint between a pair of stringers to ensure proper balancing and ease of egress and ingress of the load through a cut-out leading to the attic. The load lifting system may travel with the attic ladder when it is deployed. The step braces may engage the respective steps of the attic ladder by the use of a fastener to clamp, abut, or pierce the step to provide a more sturdy and resilient installation. The step braces may be affixed to a bottom surface of either the rail, the belt guide, or the center of the combined rail and belt assembly. The step braces may have a C-shaped cross-section. There may be three step braces which may be mounted onto a lower one of the steps. There may be three step braces which are mounted onto a lower one of the steps. There may be three step braces mounted onto an intermediate one of the steps. There may be three steps braces mounted onto an upper one of the steps.

The rail and the belt guide may be coextensive with each other and are affixed to each other along a common mating side. The combined rail and the belt guide may be variable. The combined rail and the belt guide may span the length of the topmost step. The combined rail and the belt guide may span the length of the bottommost step. The winch mounting plate may extend perpendicularly away from the belt guide opposite that from the rail. The winch may have a rotating means in operable communication with a hand crank manipulated by a user. The rollers may provide enough tension on the belt to restrict, minimize, or eliminate catching or stuttering of travel of the platform floor relative to the rail. The rail height may be three inches and the width of each is four inches. The rail height may be three inches and the width of each is four inches.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
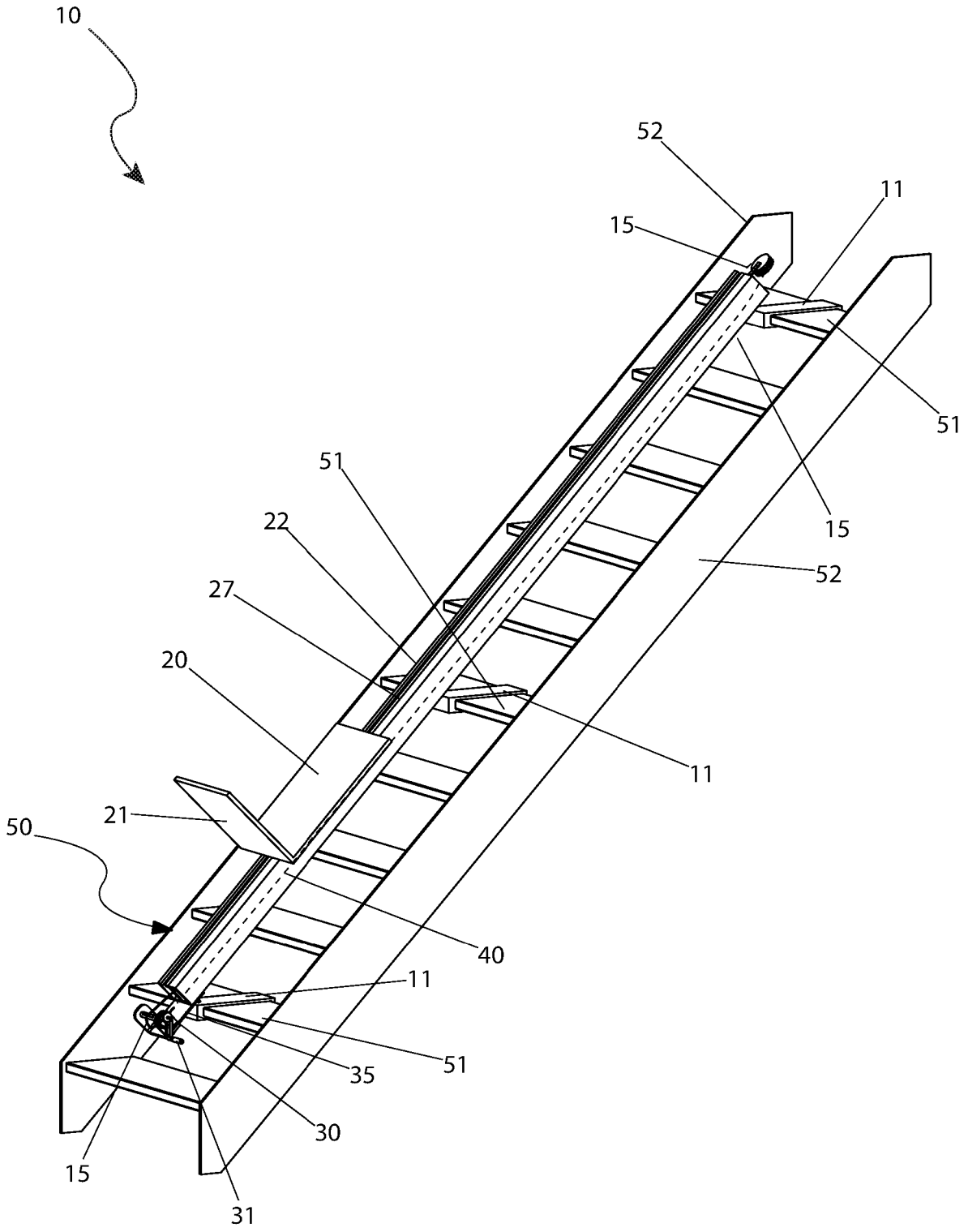
FIG. 1 is a side environmental view of a load lifting system 10 as installed on an attic ladder 50, according to the preferred embodiment of the present invention.

10 load lifting system
11 cross member

12 pulley
15 belt
20 platform floor
21 platform wall
22 rail
27 groove
30 winch
31 hand crank
35 winch mounting plate
36 fastener
40 belt guide
41*a* first roller
41*b* second roller
50 attic ladder
51 step
52 stringer
60 ratchet gear
65 stop lever
70 drum
75 axle shaft
80 support flanges
85 hexagonal section
90 drive cap
95 chuck
100 power drive tool 1. Description of the Invention The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

2. Detailed Description of the Figures

Referring now to FIG. 1, an environmental view of a load lifting system 10 capable of being removably installed on an attic ladder 50. The system 10 is capable of being quickly and securely installed on the attic ladder 50 when it is desired to transfer a load either up the attic ladder 50 or down the attic ladder 50. It is preferred that the system 10 is installed on the attic ladder 50 when the attic ladder 50 is deployed, although other methods of use can provide that the system 10 is always installed on the attic ladder 50 and travels with the attic ladder 50 when it is deployed. The system 10 is typically installed on the steps 51 of the attic ladder 50, preferably at a midpoint between the stringers 52 to ensure proper balancing and ease of egress and ingress of the load through the cut-out leading to the attic. It is understood that the step braces 11 of the system 10 engage the respective step 51 of the attic ladder 50 by wrapping around the front, rear, and entire top of the respective step 51, but other embodiments may provide for the use of a fastener (not shown) to clamp, abut, or pierce the step 51 to provide a more sturdy and resilient installation.

Figure 2:
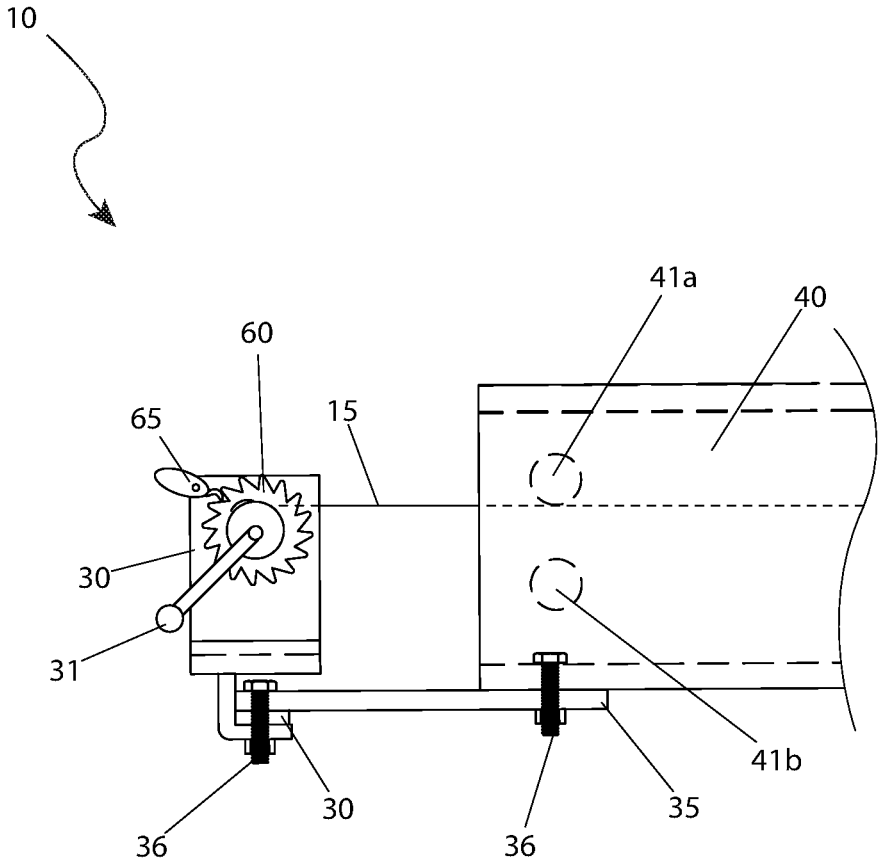
FIG. 2 is a side view of a bottom of the load lifting system 10, according to the preferred embodiment of the present invention.
Figure 3:
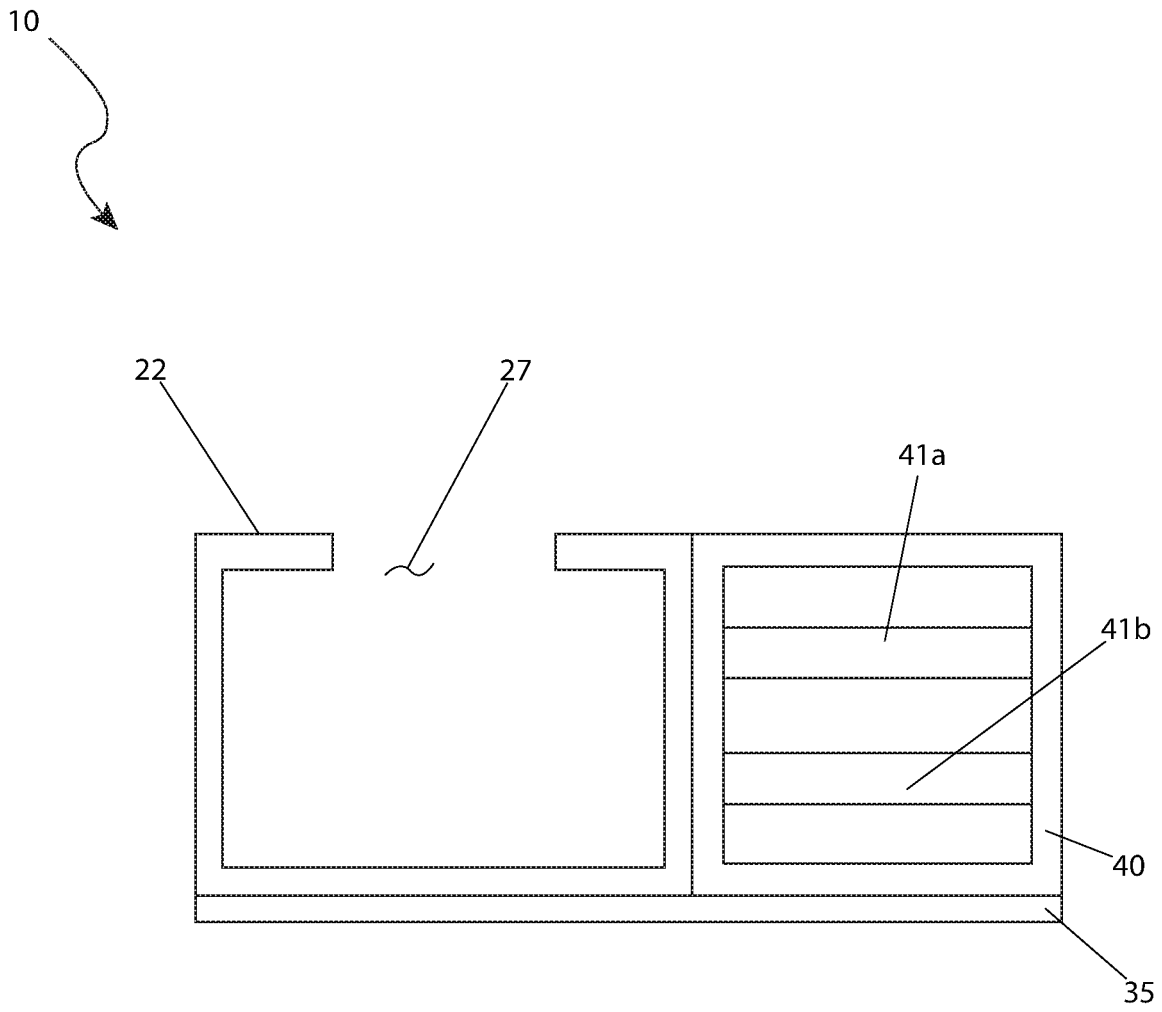
FIG. 3 is a close-up end view of the bottom of the load lifting system 10, according to the preferred embodiment of the present invention.
Figure 4:
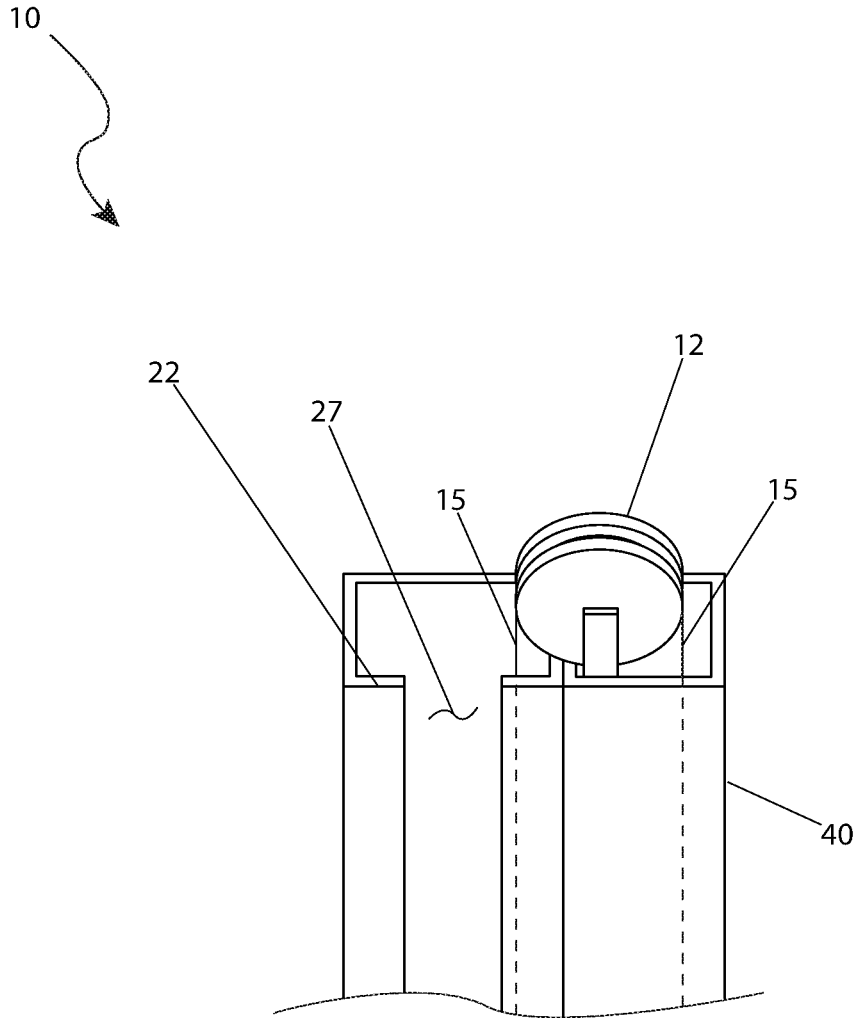
FIG. 4 is a close-up end view of the top of the load lifting system 10, according to the preferred embodiment of the present invention; and, FIG. 5 is a close-up top view of the bottom of the load lifting system 10, according to the preferred embodiment of the present invention.

Referring now more closely to FIGS. 2-4, various close-up views of portions of the system 10 are herein disclosed. The system 10 includes a rail 22, a belt guide 40, a winch 30, and a platform 20, 21. The rail 22 and belt guide 40 are each coextensive with each other and are affixed to each other along a common mating side. The preferred height of each is three inches (3 in.) and the preferred width of each is four inches (4 in.). A plurality of step braces 11 are affixed to a bottom surface of either the rail 22, the belt guide 40, or the center of the combined rail 22 and belt guide 40 assembly. Other embodiments may provide for determining the longitudinal center of weight of the fully assembled system 10 and locating the step braces 11 thereat. The step braces 11 as aforementioned are shaped to fully cover the front, top surface, and rear of an individual step 51 of the attic ladder 50. As such, their cross-section is generally "C"-shaped. Preferably, there are three (3) step braces 11, capable of mounting onto a lower one (1) of the steps 51, an intermediate one (1) of the steps 51, and an upper one (1) of the steps 51, although other numbers of step braces 11 are envisioned to fall under the scope of the invention. The length of the combined rail 22 and belt guide 40 assembly can be variable, but preferably is such that it spans the length of the topmost step 51 and adjacent or at the bottommost step 51.

The rail 22 is a hollow rectangular tubular element with a longitudinal groove 27 located at a center point of the upper surface and coextensive with the length of the rail 22. The belt guide 40 is a hollow rectangular tubular element with an open upper end and an open lower end. A winch plate 35 is secured to the bottom surface of the bottom of the belt guide 40 with at least one (1) fastener 36 and extends rearwardly therefrom. Other embodiments can provide for the winch mounting plate 35 to extend perpendicularly away from the belt guide 40 opposite that from the rail 22. At least one (1) fastener mounts the winch 30 to the winch mounting plate 35, such that it is aligned with the open end at the bottom of the belt guide 40. A pair of rollers 41*a* 41*b* are vertically aligned with each other and are rotatably mounted to inner surfaces of the belt guide 40 and located adjacent to the open bottom end. The winch 30 has a rotating means in operable communication with a hand crank 31, capable of being manipulated by a user. A ratchet gear 60 and a corresponding stop lever 65 is provided to ensure that platform floor 20 and the platform wall 21 does not accelerate downward in an unwanted manner.

Attached to an inner surface of the belt guide 40 and extending forwardly away from the upper open end thereof is a pulley 12. A belt 15 or cable has a first end attached to the winch 30 and is operably controlled thereby. The second end of the belt 15 is attached to the platform floor 20. The belt 15 travels between said pair of rollers 41*a*, 41*b*, within said belt guide 40, and engages said pulley 12. The platform floor 20 preferably is a planar member, having a centrally located portion (not shown) the protrudes downward and is captured within the groove 27 of the rail 22. It is this centrally located portion that the second of the belt 15 is attached to. The centrally located portion slidably engages the rail 22 in a frictionless or otherwise smooth connection so as to enable the platform floor 20 to travel along the groove 27 of the rail 20 as the belt 15 pulls the platform floor 20 upon movement of the winch 30. A reverse movement when the winch 30 releases the tightness of the belt 15 against the platform floor 20 enables the platform floor 20 to travel downward along the rail 22.

The rollers 41*a*, 41*b* can provide enough tension on the belt 15 to restrict, minimize, or eliminate the "catching" or "stuttering" of travel of the platform floor 20 relative to the rail 22 can be utilized, as well as straps or lips or other similar devices on the platform floor 20 to minimize or eliminate load movement during travel of the platform floor 20 is also envisioned. A platform wall 21 is preferably provided to provide a backstop at the lower end of the platform floor 20 to restrict the gravitational pull of the load during use of the system 10.

Figure 5:
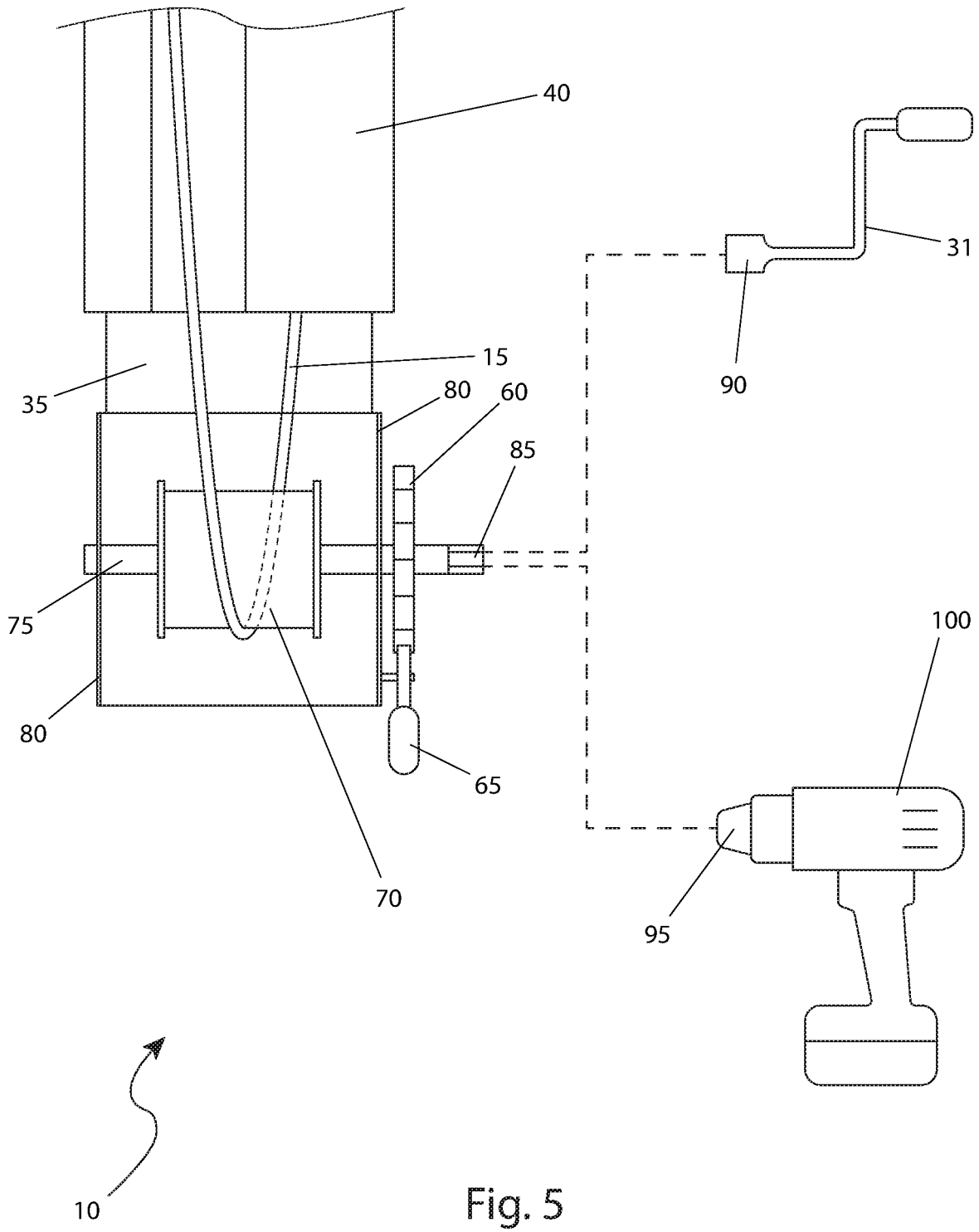

Referring to FIG. 5, a close-up top view of the bottom of the load lifting system 10, according to the preferred embodiment of the present invention. The belt 15 is routed around a drum 70 which is mounted upon an axle shaft 75 which is in physical communication with two (2) support flanges 80. As aforementioned described, the support flanges 80 are in held in a fixed mechanical connection to the belt guide 40 via the winch mounting plate 35. Located exterior to the right support flange 80, with respect to the drum 70 is the ratchet gear 60 and associated stop lever 65. The distal right side of the axle shaft 75 is provided with a hexagonal section 85 which accepts either a drive cap 90 provided as part of the crank 31 or can accept the chuck 95 of a power drive tool 100 such as a cordless drill (as depicted) or a corded drill, an impact driver, or the like. Direction of travel of the platform floor 20 and the platform wall 21 (both as shown in FIG. 1) can be changed by simply turning the crank 31 or the power drive tool 100 in an opposite direction.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A load lifting system, comprising:

a ladder having a plurality of steps, the load lifting system installed on the steps of the ladder;

a plurality of step braces engaging the respective steps of an attic ladder by wrapping around the front, rear, and entire top of each of the respective steps;

a rail having a hollow rectangular tubular element with a longitudinal groove located at a center point of the upper surface and coextensive with the length of the rail;

a belt guide having a hollow rectangular tubular element with an open upper end and an open lower end;

a winch mounting plate secured to a bottom surface of the belt guide with at least one fastener and extends rearwardly therefrom;

a pair of rollers vertically aligned with each other and are rotatably mounted to one or more inner surfaces of the belt guide and are located adjacent to the open bottom end;

a platform floor having a platform wall, the platform floor traveling downward along the rail, the platform floor preferably is a planar member having a centrally located portion that protrudes downward and is captured within the longitudinal groove of the rail;

a ratchet gear and a corresponding stop lever provided to ensure that platform floor and the platform wall does not accelerate downward in an unwanted manner;

a pulley attached to an inner surface of the belt guide and extending forwardly away from the upper open end; and a belt having a first end attached to the winch and is operably controlled thereby and a second end, the second end of the belt is attached to the platform floor and the belt travels between said pair of rollers within said belt guide and engages said pulley;

wherein step braces affixed to a bottom surface of either the rail, the belt guide, or the center of the combined rail and the belt guide; and wherein a reverse movement when the winch releases the tightness of the belt against the platform floor enables the platform floor to travel downward along the rail.

2. The load lifting system according to claim 1, wherein the load lifting system is installed on the steps of the attic ladder at a midpoint between a pair of stringers to ensure proper balancing and ease of egress and ingress of the load through a cut-out leading to the attic.

3. The load lifting system according to claim 2, wherein the load lifting system travels with the attic ladder when it is deployed.

4. The load lifting system according to claim 1, wherein the step braces engaging the respective steps of the attic ladder the use of a fastener to clamp, abut, or pierce the step to provide a more sturdy and resilient installation.

5. The load lifting system according to claim 1, wherein the step braces are affixed to a bottom surface of either the rail, the belt guide, or the center of the combined rail and belt assembly.

6. The load lifting system according to claim 1, wherein the step braces have a C-shaped cross-section.

7. The load lifting system according to claim 1, wherein there are three step braces mounting onto a lower one of the steps.

8. The load lifting system according to claim 1, wherein there are three step braces mounting onto a lower one of the steps.

9. The load lifting system according to claim 1, wherein there are three step braces mounting onto an intermediate one of the steps.

10. The load lifting system according to claim 1, wherein there are three steps braces mounting onto an upper one of the steps.

11. The load lifting system according to claim 1, wherein the rail and the belt guide are coextensive with each other and are affixed to each other along a common mating side.

12. The load lifting system according to claim 1, wherein the combined rail and the belt guide is variable.

13. The load lifting system according to claim 1, wherein the combined rail and the belt guide spans the length of the topmost step.

14. The load lifting system according to claim 1, wherein the combined rail and the belt guide spans the length of the bottommost step.

15. The load lifting system according to claim 1, wherein the winch mounting plate extends perpendicularly away from the belt guide opposite that from the rail.

16. The load lifting system according to claim 1, wherein the winch has a rotating means in operable communication with a hand crank manipulated by a user.

17. The load lifting system according to claim 1, wherein the rollers provide enough tension on the belt to restrict, minimize, or eliminate catching or stuttering of travel of the platform floor relative to the rail.

18. The load lifting system according to claim 1, wherein the rail height is three inches and the width of each is four inches.

* * * * *